United States Patent [19]

Brinkmann et al.

[11] Patent Number: 4,618,275

[45] Date of Patent: Oct. 21, 1986

[54] METHOD FOR RESETTING THE PRINTING HEAD OF A TYPEWRITER

[75] Inventors: Gerhard Brinkmann, Schortens; Bolko Wietrzynski, Wilhelmshaven, both of Fed. Rep. of Germany

[73] Assignee: Olympia Werke AG, Fed. Rep. of Germany

[21] Appl. No.: 704,422

[22] Filed: Feb. 22, 1985

[30] Foreign Application Priority Data

Mar. 22, 1984 [DE] Fed. Rep. of Germany ..... 3410505

[51] Int. Cl.[4] ..... B41J 11/42

[52] U.S. Cl. ..... 400/76; 400/279; 400/695

[58] Field of Search ..... 400/63, 279, 697, 697.1, 400/695, 705.1, 706, 707.5, 709, 568, 76; 340/749

[56] References Cited

U.S. PATENT DOCUMENTS 4,252,451 2/1981 Clancy et al. ..... 400/697.1 X

FOREIGN PATENT DOCUMENTS 2920597 11/1979 Fed. Rep. of Germany .

48170 3/1984 Japan ..... 400/63

48173 3/1984 Japan ..... 400/63

*Primary Examiner*—Charles Pearson

*Attorney, Agent, or Firm*—Wood, Herron & Evans

[57] ABSTRACT

Method for resetting the print head of a typewriter or similar machine to a starting position. In a processor-controlled typewriter or similar machine, the steps of a vertical repositioning of the recording medium are added and stored. If the added value indicates an upward movement of the recording medium, this value is cancelled as a character is printed. If, contrarily, a downward movement of the recording medium is indicated, the value is retained. Moreover, the current horizontal position of the printing head and, when it is repositioned horizontally, also the position of the last printed character, are stored. Upon initiation of an automatic reset function of the printing head to the end of the printed text, after a repositioning in horizontal and/or vertical direction, for instance for purposes of a correction, the stored information is evaluated for activation of the printing head drive and the recording medium drive.

3 Claims, 3 Drawing Figures

METHOD FOR RESETTING THE PRINTING HEAD OF A TYPEWRITER

BACKGROUND OF THE INVENTION

This invention relates to typewriters and similar machines and is particularly directed to a method for resetting the printing head of a processor-controlled typewriter or similar machine to the end of a text printed on an inserted recording medium through initiation of an automatic reset function after a preceding positioning of the printing head to another position.

One difficulty in operating typewriters or similar machines is constituted by the necessity of repositioning the printing head after positioning it on a previously printer character, for instance for making a correction back to the end of the previously typed text, so as to resume typing. With conventional machines the operator was forced to perform such resetting by correspondingly frequent manual activation of the stepping function and additionally checking the exact resumption of the end position. Corrections of previously printed text are relatively frequently made, especially on machines equipped with a correction feature, for which reason the manual resetting involves an appreciable time requirement.

To remedy this disadvantage, it has been suggested to store the current horizontal position of the printing head in two different registers and update the content of one of the registers as the printing head is repositioned along the line to a previously printed character while the content of the other register is retained. For purposes of restoring the previous printing head position, the difference between the two register contents is developed and utilized with the aid of a counter for controlling the stepping action (German patent document No. 29 20 597).

This prior device is limited to automatically repositioning the printing head along the line printed last. This feature is helpful in all those cases where the operator notices an error shortly after typing or printing it and makes a correction immediately.

The problem underlying the invention is eliminating the limitation associated with the solution according to the state of the art to an automatic respositioning after printing head movements effected only along the last line printed.

SUMMARY OF THE INVENTION

In accordance with the present invention, this problem is solved by providing a method for resetting the printing head involving the steps of storing the current horizontal position of the printing head and the next character of the printed text, developing positive or negative signals corresponding to the steps of vertical movement of the recording medium, the polarity of the signals corresponding to the upward or downward direction of the movements, adding the signals and storing the sum thereof. The method also involves the steps of cancelling the stored number of steps of upward movement upon initiation of a character impression while retaining the stored number of steps of downward movement and, thereafter, upon initiation of a reset function, evaluating the stored number of steps for controlling movement of the recording medium in accordance with the directional sign indicating the relative position to the last printing line. Finally, the printing method involves the steps of evaluating the difference between the stored horizontal position of the printing head and the last character typed for controlling the horizontal repositioning of the printing head to the last blank printing position behind the last character.

The advantages of the invention are constituted especially by the fact that the operator of such a machine may perform text corrections, for instance correcting errors, cancelling or entering a character, etc., at any point of the printed text, and that the printing head positioned on such a correction point will, upon actuation of a reset function, automatically return to the next blank printing position behind the last character of the last line. After making any number of corrections at any point of the printed text, the operator needs to press only one reset key in order to then resume typing the text stream.

Other advantages of the present invention will be more readily apparent from a consideration of the following detailed description of the drawings illustrating a preferred embodiment of the invention.

DESCRIPTION OF A PREFERRED EMBODIMENT

Figure 1:
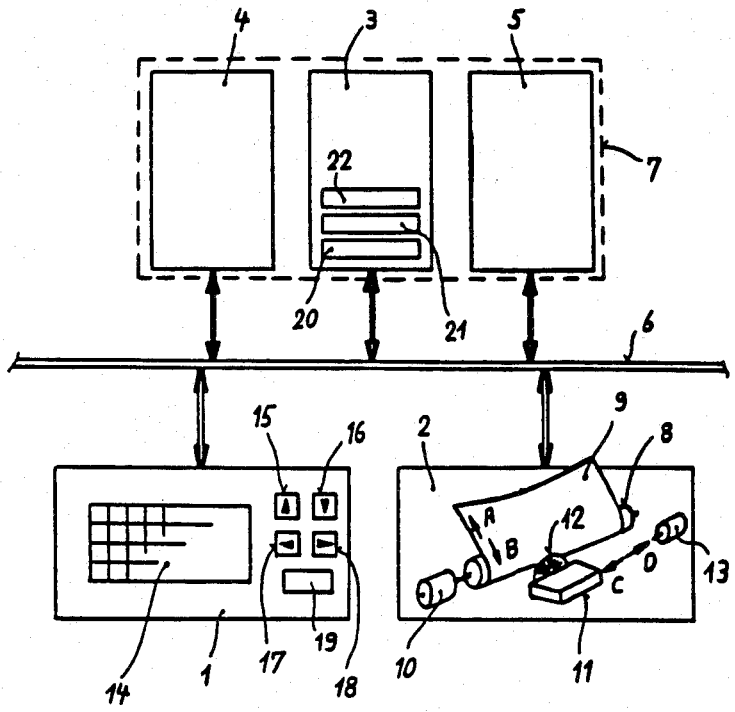
FIG. 1 shows a block diagram of a typewriter embodying the present invention.

Presented in FIG. 1, the block diagram of a preferred embodiment of a typewriter of the present invention shows only the elements which are necessary for understanding the invention, namely, a keyboard 1, printing unit 2, and a control unit 3 with a program memory 4 and a data memory 5 connecting with each other through a bus 6. The control unit 3, program memory 4 and data memory 5 are integral parts of a microprocessor control 7 of the machine, for which reason all of the modules mentioned hereafter and partaking in the control, for instance counter and comparator, may basically be substituted by program routines.

Among other things, the printing unit 2 comprises a platen 8 which makes it possible to stepwise advance in customary fashion a recording medium 9 in vertical direction, upward (direction of arrow A) or downward (direction of arrow B). The related drive is provided by a motor 10 permitting stepwise activation. A printing head 11 featuring a rotatable print wheel as character medium is horizontally movable in the direction of arrows C and D by another motor 13 permitting stepwise activation. As usual, the characters of a text line can thus be printed on the recording medium 9 through horizontal positioning of the printing head and respective rotation of the print wheel 12 to the character to be printed, while the text lines can be arranged one below the other by advancing the recording medium 9 in vertical direction.

In addition to a character field 14 which permits the typing of characters to be printed, the keyboard 1 features various function keys of which here only a key 15 for the upward advance of the recording medium 9, a key 16 for the reverse indexing of the recording medium 9, a key 17 for positioning the printing head 11 leftward, a key 18 for positioning the printing head 11 to the right, and a key 19 for activating the reset function of the printing head 11 are illustrated.

Figure 2A:
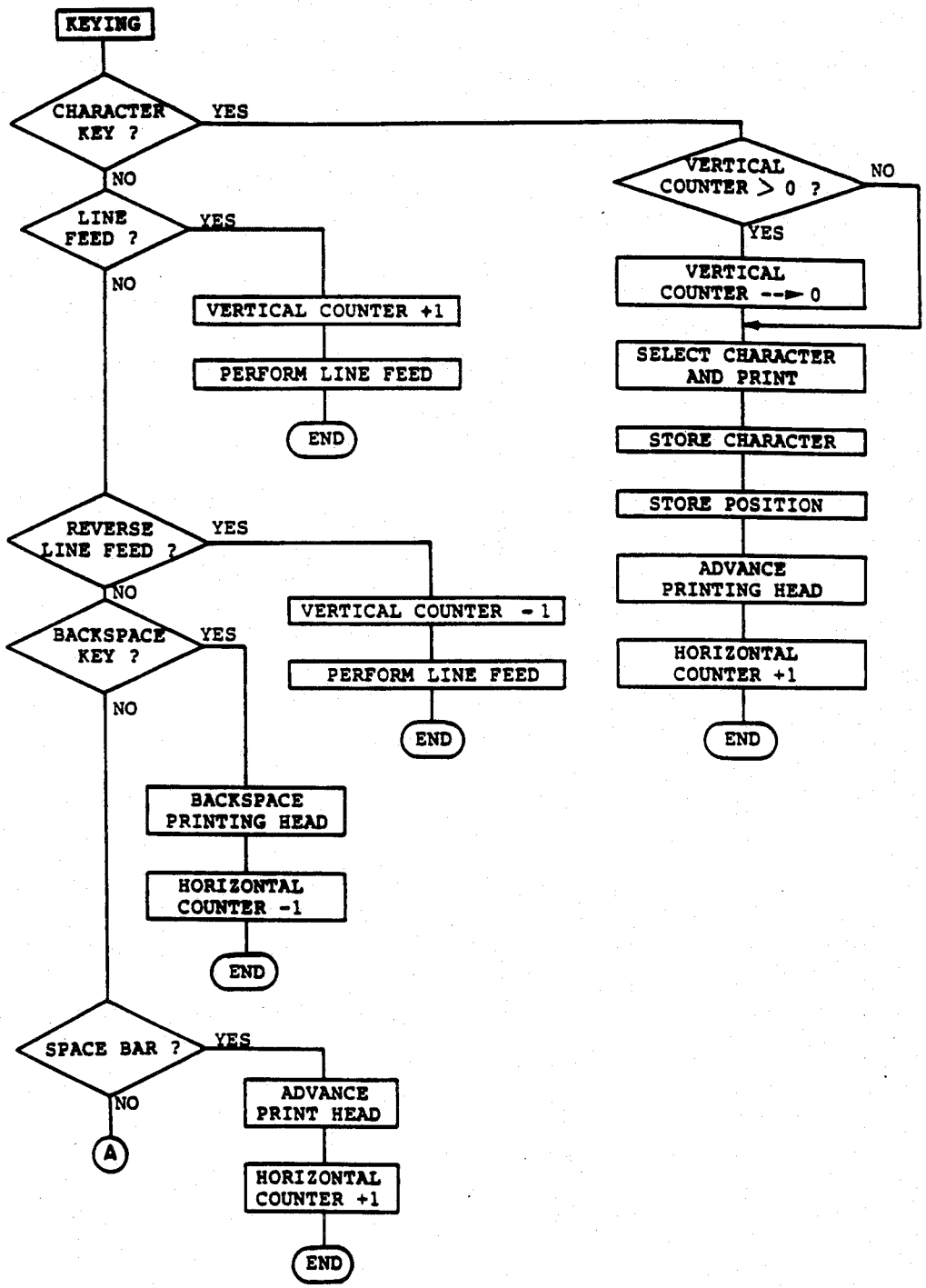
FIGS. 2A and 2B show a flow chart.
Figure 2B:
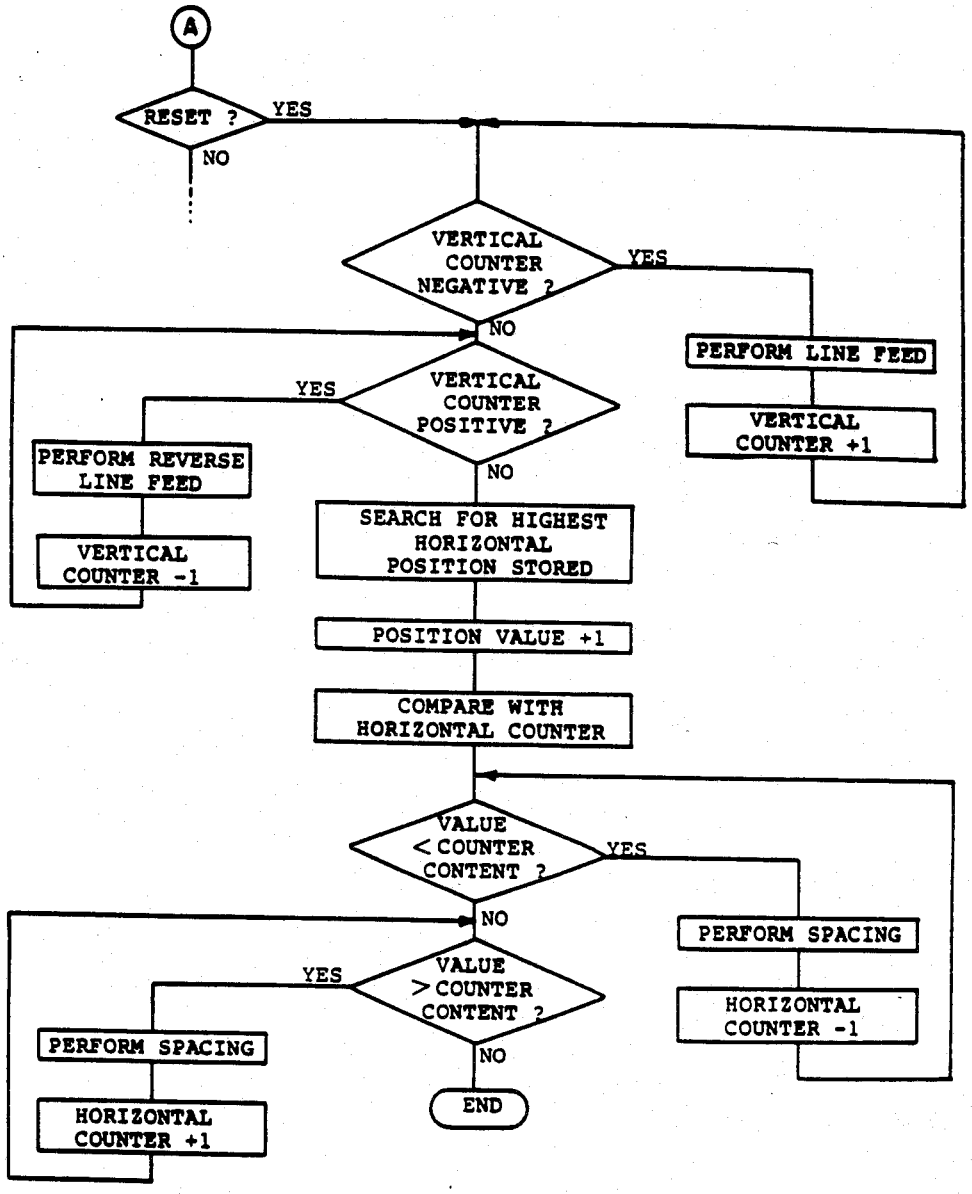

The functional sequences upon pressing the various keys will be explained hereafter with the aid of the flow chart relative to FIGS. 2A and 2B. A keyboard scan conducted in swift succession determines which of the keys of the keyboard 1 have been pressed. For instance, if only the command key 15 was pressed, the key code derived from it will cause the number of steps to be performed, depending on the frequency of key operation and/or the basic step number underlying the recording medium advance, to be added in a vertical counter 20 to any already existing content with positive sign and stored. Moreover, the stepping motor 10 is activated for advancing the recording medium 9 in the direction of arrow A, that is upward, for the instructed number of steps. If, contrarily, the command key 16 was pressed, the key code causes the control 7 to perform an addition of the instructed number of steps with a negative sign in the vertical counter 20, activating the motor 10 for a recording medium 9 movement in the direction of arrow B by this number of steps. After vertical movements of the recording medium, the vertical counter 20 thus contains the number of steps by which the recording medium 9 was repositioned in vertical direction relative to the printing head 11. The sign of the counter content indicates the repositioning direction.

Any step initiated by pressing a key for a vertical or horizontal advance may consist, without departing from the present invention, of several elemental steps to be performed by the respective motors 10, 13. In this case, correspondingly many activation signals are transmitted to the motors 10, 13, and the number of elemental steps of the respective advance step initiated is utilized for the pertaining stepping counters and arithmetic operations. For the sake of simplicity, however, the description and FIGS. 2A and 2B base for each step activation on only one counter step and one advance step.

If a character key was pressed in the keyboard section 14, the control 7 initiates a test of the vertical counter 20 for the presence of a positive sign of the counter content. During the normal text stream, the vertical counter 20 will not contain a negative value and a positive value only after a line return. When such a positive value is determined, the vertical counter 20 is reset to 0. But if on account of previously pressing the key 16 the recording medium 9 was reverse-indexed with the result that the printing head is positioned above the last printing line, the vertical counter 20 contains a value with a negative sign. This value is not cancelled as a character key is pressed. Further along in the sequence, the control 7 causes the print wheel 12 to rotate the character coordinated with the pressed character key into the printing position. Next, the character is printed as usual. The character code of the printed character is stored in the data memory 5 and, coordinated with it, the horizontal position of the character derived from a horizontal counter 21 is stored in another memory location. Next, the motor 13 for repositioning the printing head 11 by one column position to the next printing position is advanced to the right and the horizontal counter 21 is incremented by one and/or a corresponding number of elemental steps.

Serving to count from the line start every stepping movement of the printing head 11 by addition or subtraction of the respective step number, depending on the direction of movement, the horizontal counter 21 contains thus at any time information on the current position of the printing head. For instance, if the command key 17 is pressed, the printing head 11 is repositioned leftward by one column step in the direction of arrow C, and the content of the horizontal counter 21 is decremented by one step. Contrarily, pressing the command key 18 causes the printing head 11 to advance one column in the direction of arrow D, to the right, and the content of the horizontal counter 21 will be incremented by one step.

It is presumed that for purposes of a correction the recording medium 9 was moved by a specific number of steps in the direction of arrow B, vertically downward, and the printing head 11 by several steps in the direction of arrow C, horizontally to the left. The operator has made the desired correction and presses now the command key 19 for resetting the printing head 11. The control unit determines whether the vertical counter 20, updated during the vertical movement of the recording medium 9 by the number of steps, has a content with a negative sign. If yes, the motor 10 continues to be activated for an upward movement of the recording medium 9 in the direction of arrow A under simultaneous addition of the steps to the counter content, until the vertical counter 20 reaches 0 value. This is followed by a search of the data memory 5 for the highest position of a printed character. This position is read and incremented by one column step. The value so arrived at is compared with the content of the horizontal counter 21, which shows the actual position of the printing head 11, in a comparator 22. In the assumed example, it will be found that the printing head position is smaller than the set position read from the memory and incremented by one column step. As a result, the printing head 11 continues to be moved by the motor 13 in the direction of arrow D, under simultaneous addition of the steps to the content of horizontal counter 21, until the comparison produces a value of 0. The printing head is now positioned on the first blank printing position to the right of the character printed last in the bottommost line, and the operator may resume typing.

If, on the other hand, the printing head 11 had been to the right of the set position read from the memory and incremented by one column step, the comparison of the content of horizontal counter 21 with the set position would have shown the horizontal set position to be smaller than the actual position of the printing head 11. The motor 13 would then have been activated for performing an advance movement in the direction of arrow C, leftward, and the number of steps would simultaneously have been subtracted from the horizontal 21 content until the comparison would again have produced the value 0. The print head would then also have been positioned in the first blank printing position to the right of the last character.

A fourth case is concerned when, by pressing the command key 15, the recording medium 9 was fed upward in the direction of arrow A. The printing head 11 is then positioned below the previously printed text and opposite the blank recording medium 9, while the vertical counter 20 contains the number of steps performed with a positive sign. When now pressing the reset key 19 before pressing a character key, the test of the vertical counter 1 shows that a positive value is on hand. The motor 10 is then activated for performing a feed movement of the recording medium 9 in the direction of arrow B until the appropriately decremented content of the vertical counter 20 reaches a value of 0. Subsequent to it, the printing head 11 has been reset again to the last printed line, and any necessary resetting in horizontal direction is performed as described above.

From the above disclosure of the general principles of the present invention and the preceding detailed description of a preferred embodiment, those skilled in the art will readily comprehend the various modifications to which the present invention is susceptible. It is to be understood that the word typewriter as used in the following claims refers to a typewriter or similar machine. Therefore, we desire to be limited only by the scope of the following claims.

Having described our invention, we claim:

1. The method for resetting the printing head of a processor-controlled typewriter to the end of a text printed on an inserted recording medium through initiation of an automatic reset function after a preceding positioning of the printing head to another position, said method comprising the steps of:

storing the current horizontal position of the printing head and of the last character of the printed text;

developing signals corresponding to the steps of vertical movement of the recording medium, said signals having a positive or negative characteristic sign corresponding to the direction of upward and downward movements;

adding said signals and storing the sum thereof, said sum indicating the number of steps of vertical movement of the record media;

cancelling the stored number of steps of upward movement of the recording medium upon initiation of a character impression;

retaining the stored number of steps of downward movement upon initiation of a character impression;

upon initiation of a reset function, evaluating the stored number of steps for controlling a movement of the recording medium in accordance with the characteristic directional sign indicating the relative position to the last printing line;

evaluating the difference between the stored horizontal position of the printing head and the last character typed for controlling the horizontal repositioning of the printing head leftwardly and rightwardly as dictated by said difference to the last blank printing position behind the last character.

2. The method of claim 1 in which the typed characters in their typing sequence are stored in a multiple digit memory together with their horizontal positions on the recording medium.

3. The method of claim 2 in which upon initiation of a reset function the vertical resetting to the last line takes place first and, thereafter, the multiple digit memory is searched to determine the highest stored horizontal position, which position is read out for producing the difference from the horizontal position of the printing head.

* * * * *